US010624449B2

(12) United States Patent
Zijlstra et al.

(10) Patent No.: US 10,624,449 B2
(45) Date of Patent: Apr. 21, 2020

(54) METHODS AND SYSTEMS FOR PERSONAL CARE DEVICE LOCALIZATION

(71) Applicant: KONINKLIJKE PHILIPS N.V., Eindhoven (NL)

(72) Inventors: Aaldert Geert Zijlstra, Zuidlaren (NL); Steven Charles Deane, Cambridge (GB)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/330,504

(22) PCT Filed: Oct. 30, 2017

(86) PCT No.: PCT/EP2017/077718
§ 371 (c)(1),
(2) Date: Mar. 5, 2019

(87) PCT Pub. No.: WO2018/086924
PCT Pub. Date: May 17, 2018

(65) Prior Publication Data

US 2019/0254414 A1 Aug. 22, 2019

Related U.S. Application Data

(60) Provisional application No. 62/418,871, filed on Nov. 8, 2016.

(51) Int. Cl.
*A46B 15/00* (2006.01)

(52) U.S. Cl.
CPC ..... *A46B 15/0006* (2013.01); *A46B 15/0004* (2013.01); *A46B 2200/1006* (2013.01); *A46B 2200/1066* (2013.01)

(58) Field of Classification Search
CPC ..... A46B 15/0002; A46B 15/0004; A46B 15/0006; A46B 15/0038; A46B 15/0008; A46B 15/001
See application file for complete search history.

(56) References Cited

U.S. PATENT DOCUMENTS 6,081,957 A 7/2000 Webb
6,425,295 B1 * 7/2002 Meginniss ..... A46B 15/0002 73/862.046

(Continued)

FOREIGN PATENT DOCUMENTS

CN 204501067 U 7/2015
EP 1698252 A2 9/2006

(Continued)

*Primary Examiner* — Laura C Guidotti

(57) ABSTRACT

A method (500) for characterizing a personal care device (10). The method includes the steps of: (i) providing (510) a personal care device comprising a plurality of tufts (18), where a first one (18*a*) of the plurality of tufts includes a first tactile sensor (38*a*) and comprises a first angle relative to a device head, and further where a second one (18*b*) of the plurality of tufts includes a second tactile sensor (38*b*) and comprises a second angle relative to the device head; (ii) generating (520), in response to interaction of the plurality of tufts with a use surface (40), first sensor data by the first tactile sensor and second sensor data by the second tactile sensor; and (iii) characterizing (530), by the controller using the first sensor data and the second sensor data, a position of the personal care device within the use area.

18 Claims, 8 Drawing Sheets

(56) References Cited

U.S. PATENT DOCUMENTS

| | | | | |
|---|---|---|---|---|
| 6,536,068 | B1 | 3/2003 | Yang et al. | |
| 2016/0317267 | A1 | 11/2016 | Meerbeek et al. | |
| 2016/0374609 | A1* | 12/2016 | Vetter ..... | A61C 19/04<br>433/27 |

FOREIGN PATENT DOCUMENTS

| | | | |
|---|---|---|---|
| EP | 2522303 | A1 | 11/2012 |
| JP | H10151022 | A | 6/1998 |
| WO | 2015087219 | A1 | 6/2015 |

* cited by examiner

METHODS AND SYSTEMS FOR PERSONAL CARE DEVICE LOCALIZATION

CROSS-REFERENCE TO PRIOR APPLICATIONS

This application is the U.S. National Phase application under 35 U.S.C. § 371 of International Application No. PCT/EP2017/077718, filed on Oct. 30, 2017, which claims the benefit of U.S. Provisional Patent Application No. 62/418,871, filed on Nov. 8, 2016. These applications are hereby incorporated by reference herein.

FIELD OF THE INVENTION

The present disclosure is directed generally to methods and systems for localizing the position of, and tracking movement of, a personal care device using sensor input.

BACKGROUND

To facilitate proper use of a personal care device, modem devices have sensors embedded therein to monitor use, timing, etc. For example, electric toothbrushes have been designed to provide a timer function such that a user knows to brush for a minimum recommended amount of time. The timer function can include an audible sound, haptic feedback, or other notification mechanism to let the user know when a predetermined amount of time has elapsed. This provides the user with an indication that they have brushed their teeth for an adequate amount of time. Electric razors have been designed with sensors that can identify areas of the face that have not been shaved during a shaving session to identify missed areas. Similarly, skin cleaning devices have been designed with sensors that can identify where they have been used and where areas have been missed.

For example, for oral hygiene, proper tooth brushing, including length and coverage of brushing, and regular flossing, help ensure long-term dental health. Many dental problems are experienced by individuals who either do not regularly brush their teeth or floss, or who do so inadequately, especially in a particular area or region of the oral cavity. Among individuals who do brush and floss regularly, improper cleaning habits can result in poor coverage and thus surfaces that are not adequately cleaned during a cleaning session, even when a standard brushing or flossing regimen is followed. Another mechanism to facilitate proper brushing technique is to ensure that there is adequate cleaning of all dental surfaces, including areas of the mouth that are hard to reach or that tend to be improperly cleaned during an average brushing session. One way to ensure adequate coverage is to determine or track the position of the toothbrush in the mouth during a brushing session and compare that to a map of the dental surfaces. For example, a system with sensors positioned in fixed relationship to the teeth of the user could track the movement of a toothbrush over the user's teeth. Alternatively, the toothbrush could include one or more internal sensors that attempt to track movement of the device within the mouth. However, these localization and tracking systems are either expensive or are unable to adequately localize or track the position of the personal care device.

Accordingly, there is a continued need for personal care devices that adequately localize the device within the use area to ensure proper and complete use.

SUMMARY OF THE INVENTION

The present disclosure is directed to inventive methods and systems for localizing a personal care device within a use area, thus enabling evaluation of use of the device. For example, when applied to a system configured to localize a personal care device within the mouth, the inventive methods and systems enable greater precision of localization and tracking and thus enable an evaluation of a user's tooth brushing technique. The system utilizes one or more sensors inside the personal care device in order to determine the relative position, residence time, and translational direction of the device head with respect to the surface to be cleaned. According to an embodiment for use with an oral hygiene device, for example, the sensor data provides information about whether the device is centered with respect to a dental or interdental area, how long the device remains at a location, and/or to which direction the device is moved within the mouth, such as backward or forward.

Generally in one aspect, a method for characterizing a personal care device within a use area is provided. The method includes the steps of: (i) providing a personal care device comprising a device head having a plurality of tufts, wherein a first one of the plurality of tufts is in communication with a first tactile sensor and comprises a first angle relative to the device head, wherein the first angle is greater than or less than 90 degrees relative to the device head; (ii) generating, in response to interaction of the plurality of tufts with a surface to be cleaned, first sensor data by the first tactile sensor; and (iii) characterizing, by the controller using the first sensor data, a position of the personal care device within the use area.

According to an embodiment, the personal care device further includes a second one of the plurality of tufts in communication with a second tactile sensor and comprising a second angle relative to the device head, wherein the first and second angles are different, and further wherein the controller also uses the second sensor data during the characterizing step.

According to an embodiment, the method further includes the step of determining, using the first sensor data and/or the second sensor data, a residence time at the surface to be cleaned by the device head.

According to an embodiment, the method further includes the step of evaluating, based on the characterization, a cleaning session.

According to an embodiment, the method further includes the step of communicating the characterization.

According to an embodiment, the characterizing step comprises a comparison of the first sensor data to the second sensor data.

According to an embodiment, the personal care device comprises more than two tactile sensors.

According to an aspect is a method for characterizing a personal care device. The method includes the steps of: (i) providing a personal care device comprising a device head having a plurality of tufts, wherein a first one of the plurality of tufts is in communication with a first tactile sensor and comprises a first angle relative to the device head, and further wherein a second one of the plurality of tufts is in communication with a second tactile sensor and comprises a second angle relative to the device head, wherein the first and second angles are different; (ii) generating, in response to a movement of the plurality of tufts relative to a surface to be cleaned, first sensor data by the first tactile sensor and second sensor data by the second tactile sensor; and (iii) characterizing, by the controller using the first sensor data and the second sensor data, the movement of the personal care device relative to the surface to be cleaned.

According to an aspect is a personal care device. The personal care device includes: a device head comprising a plurality of tufts, wherein a first one of the plurality of tufts is in communication with a first tactile sensor and comprises a first angle relative to the device head, and further wherein a second one of the plurality of tufts is in communication with a second tactile sensor and comprises a second angle relative to the device head, wherein the first and second angles are different; and a controller configured to: (i) receive, in response to interaction of the plurality of tufts with a surface to be cleaned, first sensor data from the first tactile sensor and second sensor data from the second tactile sensor; and (ii) characterize, using the first sensor data and the second sensor data, a position of the personal care device within area to be cleaned.

According to an aspect is a personal care device. The personal care device includes: a device head comprising a plurality of tufts, wherein the plurality of tufts comprises a first angle relative to the device head, wherein the first and second angles are different; a body portion comprising a tactile sensor configured to detect motion of the device head relative to the body portion, wherein the first angle is configured to cause a notching movement of the device head as the plurality of angled tufts interact with a surface to be cleaned; and a controller configured to: (i) receive, in response to interaction of the plurality of tufts with a surface, sensor data from the tactile sensor; and (ii) characterize, using the sensor data, a position of the personal care device within the area to be cleaned.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF EMBODIMENTS

The present disclosure describes various embodiments of a method, system, and personal care device for characterizing the location of a personal care device within a user's mouth. More generally, Applicant has recognized and appreciated that it would be beneficial to provide a system to localize a personal care device in an area to be cleaned or otherwise treated, in order to provide feedback to the user. Accordingly, the methods and systems described or otherwise envisioned herein provide a personal care device configured to determine the location of the personal care device with respect to an area, how long the device remains at a location, and/or to which direction the device is moved within the area. According to an embodiment, the personal care device utilizes one or more sensors and tufts in order to determine the relative position, residence time, and translational direction of the device head with respect to the cleaning.

A particular goal of utilization of the embodiments and implementations herein is to provide brushing information using a personal care device such as, e.g., a Philips Sonicare™ electric toothbrush (manufactured by Koninklijke Philips Electronics, N.V.), although the assembly may be utilized with many other personal care devices such as other oral hygiene devices, face cleaners, shavers, and other devices.

Figure 1:
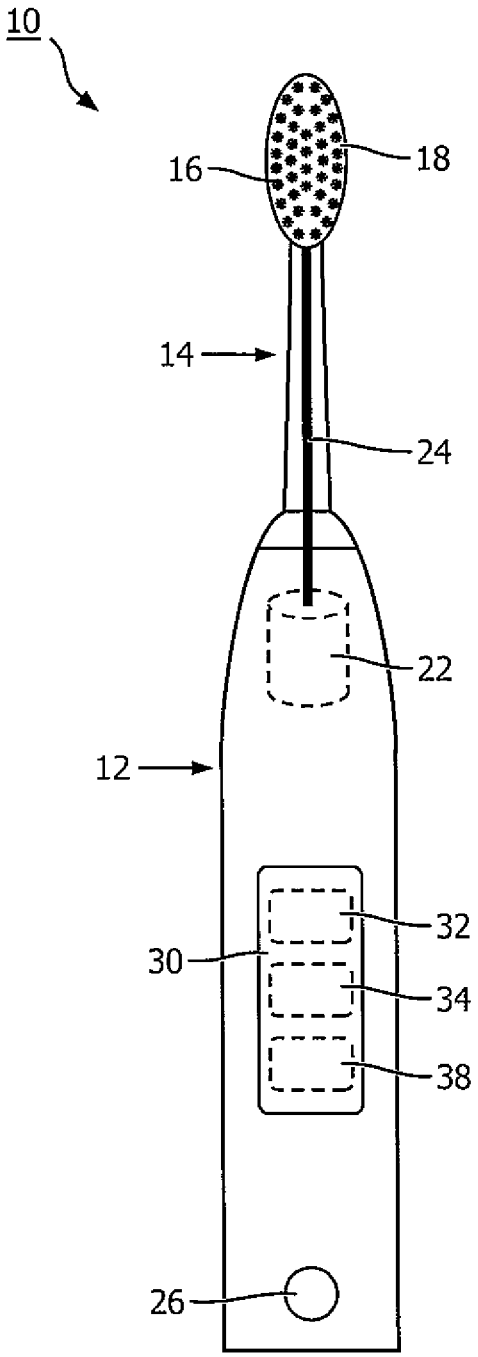
FIG. 1 is a schematic representation of a personal care device, in accordance with an embodiment.

Referring to FIG. 1, in one embodiment, personal care device 10 is provided that includes a body portion 12 and a head member 14. Head member 14 includes at its end remote from the body portion a device head 16. The body portion 12 typically comprises a housing, at least a portion of which is hollow, to contain components of the personal care device. Head member 14 is mounted so as to be able to move relative to the body portion 12. The movement can be any of a variety of different movements, including vibrations or rotation, among others.

The body portion 12 typically contains a drivetrain assembly with a motor 22 for generating movement, and a transmission component or drivetrain shaft 24, for transmitting the generated movements to head member 14. For example, the drivetrain comprises a motor or electromagnet (s) 22 that generates movement of a drivetrain shaft 24, which is subsequently transmitted to the head member 14. The drivetrain can include components such as a power supply, an oscillator, and one or more electromagnets, among other components. In this embodiment the power supply comprises one or more rechargeable batteries, not shown, which can, for example, be electrically charged in a charging holder in which personal care device 10 is placed when not in use. According to one embodiment, head member 14 is mounted to the drive train shaft 24 so as to be able to vibrate relative to body portion 12. The head member 14 can be fixedly mounted onto drive train shaft 24, or it may alternatively be detachably mounted so that head member 14 can be replaced with a different head member for different operating features, or when a component of the head member are worn out and require replacement.

The body portion 12 is further provided with a user input 26 to activate and de-activate the drivetrain. The user input 26 allows a user to operate the personal care device 10, for example to turn the device on and off. The user input 26 may, for example, be a button, touch screen, or switch.

The body portion of the device also comprises a controller 30. Controller 30 may be formed of one or multiple modules, and is configured to operate the personal care device 10 in response to an input, such as input obtained via user input 26. Controller 30 can comprise, for example, a processor 32 and a memory 34, and can optionally include a connectivity module. The processor 32 may take any suitable form, including but not limited to a microcontroller, multiple microcontrollers, circuitry, a single processor, or plural processors. The memory 34 can take any suitable form, including a non-volatile memory and/or RAM. The non-volatile memory may include read only memory (ROM), a hard disk drive (HDD), or a solid state drive (SSD). The memory can store, among other things, an operating system. The RAM is used by the processor for the temporary storage of data. According to an embodiment, an operating system may contain code which, when executed by controller 30, controls operation of the hardware components of personal care device 10. According to an embodiment, connectivity module 36 transmits collected sensor data, and can be any module, device, or means capable of transmitting a wired or wireless signal, including but not limited to a Wi-Fi, Bluetooth, near field communication, and/or cellular module.

Although the embodiment of the personal care device 10 shown in FIG. 1 is an electric toothbrush, it will be understood that many alternative embodiments of the personal care device, such as flossers, shavers, skin cleaning devices (not shown) are possible.

Figure 2:
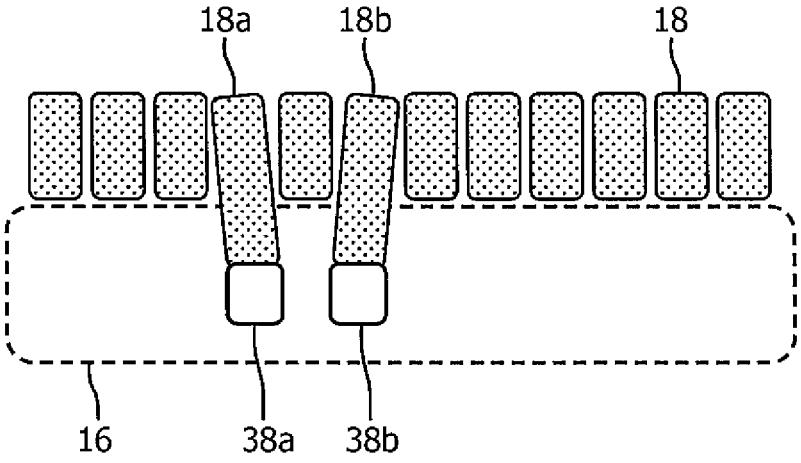
FIG. 2 is a schematic representation of a device head of a personal care device, in accordance with an embodiment.

Referring to FIG. 2, in one embodiment, a device head 16 of a personal care device 10 is provided. Device head 16 includes a plurality of or tufts 18 extending outwardly to interact with the surfaces to be cleaned. Device head 16 also includes two or more tactile sensors 38, which can be any tactile sensor. The tactile sensor is preferably at least partially embedded within the device head 16. The tactile sensor may be a ring around a tuft, may be connected at a proximal end of the tuft, and/or may be connected to the tuft via one or more intervening elements. The term "tuft" 18 as used herein can refer to a variety of components, including clusters of cleaning bristles, a mechanism for delivering a pulse of water or air, or a grooming or other cutting mechanism or components arranged on the device head 16. According to one embodiment, the tactile sensor may be achieved by mechanical connection of a base plate in which the tufts are placed in contact with a tactile sensor element. The sensor element transduces an exerted force or pressure into an electrical signal, which can be achieved with known tactile sensors based on piezo resistivity, piezoelectricity, capacitance or elasto-resistivity.

Figure 3:
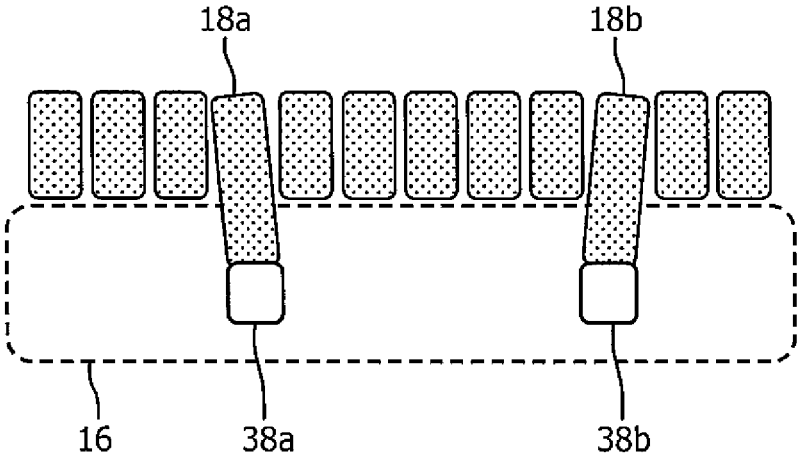
FIG. 3 is a schematic representation of a device head of a personal care device, in accordance with an embodiment.

According to an embodiment, when device head 16 is a toothbrush head, it includes tufts 18 with at least three different configurations. A first configuration embodied by a majority of the tufts 18 being substantially perpendicular to the lateral axis of the personal care device 10. A second configuration includes one or more tufts 18*a* angled in a first direction with respect to the lateral axis of the personal care device. A third configuration includes one or more tufts 18*b* angled in a second direction with respect to the lateral axis of the personal care device, where the first direction and the second direction are opposite with respect to one another. The one or more tufts 18*a* are connected or otherwise in communication with a first tactile sensor 38*a*. The one or more tufts 18*b* are connected or otherwise in communication with a second tactile sensor 38*b*. The angled tufts 18*a* and 18*b* may be in close proximity, as shown in FIG. 2, or they may be distantly spaced, as shown in FIG. 3. Although the figures only show two angled tufts and two tactile sensors, it should be appreciated that the device head may comprise multiple angled tufts and tactile sensors. For example, although the figures depict the non-sensing tufts as being non-angled, the device head may comprise both angled sensing tufts and angled non-sensing tufts. Accordingly, a device head may comprise sensing tufts and non-sensing tufts all at the same angle, or at two or more different angles.

As the personal care device is moved along surfaces to be cleaned, the angled bristle tufts 18*a* and 18*b* will interact with the surfaces, thereby eliciting sensor data from the tactile sensors. Interactions with the same surface will vary due to the different angles of the various tufts. Due to the different angles of the tufts, for example, the sensor data from the tactile sensors will be more distinct. Further, the angled configuration will enhance detection of forward and backward motion due to signal differences between the angled tufts, as discussed in greater detail herein.

In a preferred embodiment of device head 16, less than all of the tufts 18 are angled, while most comprise an angle substantially perpendicular to the lateral axis of the personal care device, as is found in most traditional device heads. Too many angled tufts would result in a large force variation that could be felt by a user, such as the feeling of notching as the tufts moved from one region to the next.

In addition to the relative angle of the tufts, the length of the tufts and the stiffness of the tuft material are important parameters for proper functioning of the personal care device. For example, the length of the tufts will impact the strength of the signal provided by the tactile sensors in communication with those tufts. Additionally, the length of the sensing tufts relative to the non-sensing tufts will have a significant impact on signal strength. For example, longer tufts may be associated with stronger signal strength, since they are in a position to receive greater forces from the surfaces. Similarly, the stiffness of the tufts will impact the strength of the signal provided by the tactile sensors in communication with those tufts. Additionally, the stiffness of the sensing tufts relative to the non-sensing tufts will have a significant impact on signal strength. Adjusting the stiffness of the tufts in communication with the tactile sensors will similarly adjust the signal strength. Accordingly, the length and/or the stiffness of the sensing tufts are parameters that can be determined during design and/or manufacturing of the personal care device or the device head.

Figure 4:
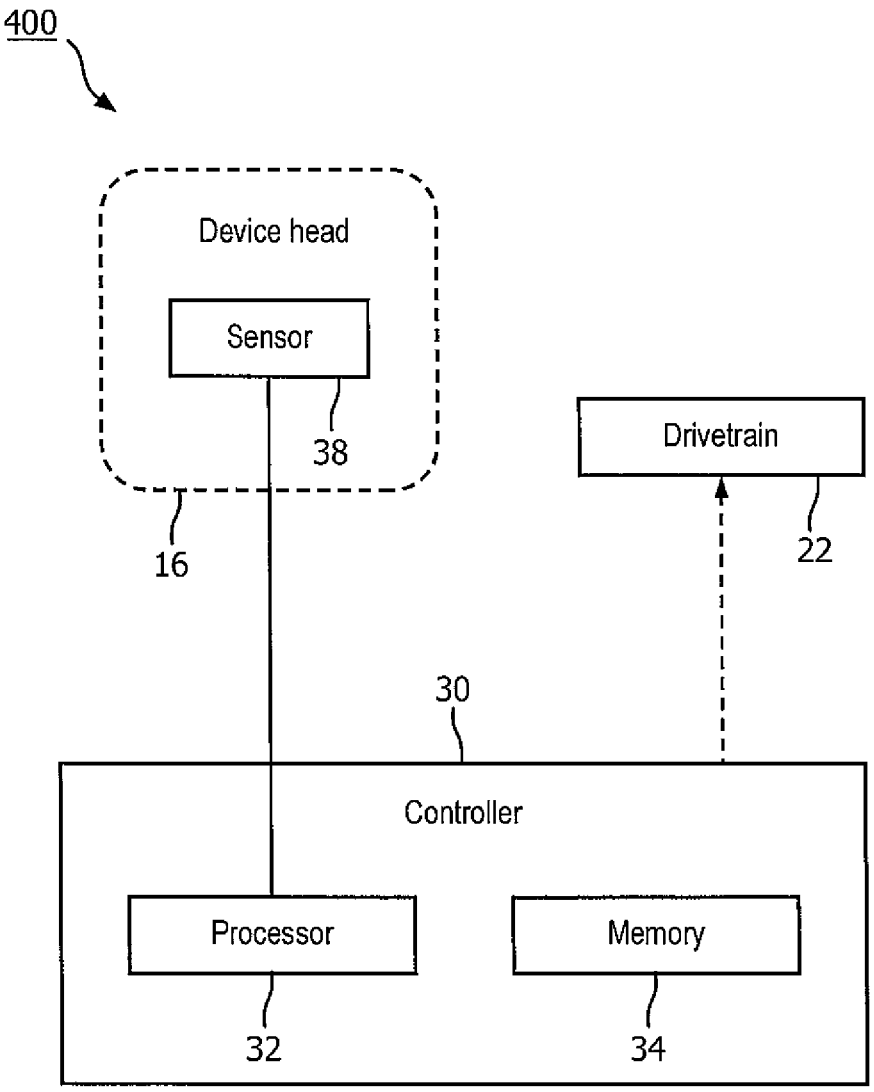
FIG. 4 is a schematic of a personal care system, in accordance with an embodiment.

Referring to FIG. 4, an embodiment of a cleaning system 400 is provided. According to an embodiment, cleaning system 400 includes one or more tactile sensors 38 in device head 16, and a controller 30 comprising a processor 32 and a memory 34. Cleaning system 400 includes a drivetrain 22, the operation of which is controlled by controller 30. The one or more tactile sensors 38 in device head 16 are in wired and/or wireless communication with controller 30, and the sensor data generated by the two or more sensors 38 is provided to controller 30 for the various analyses described herein.

Figure 5:
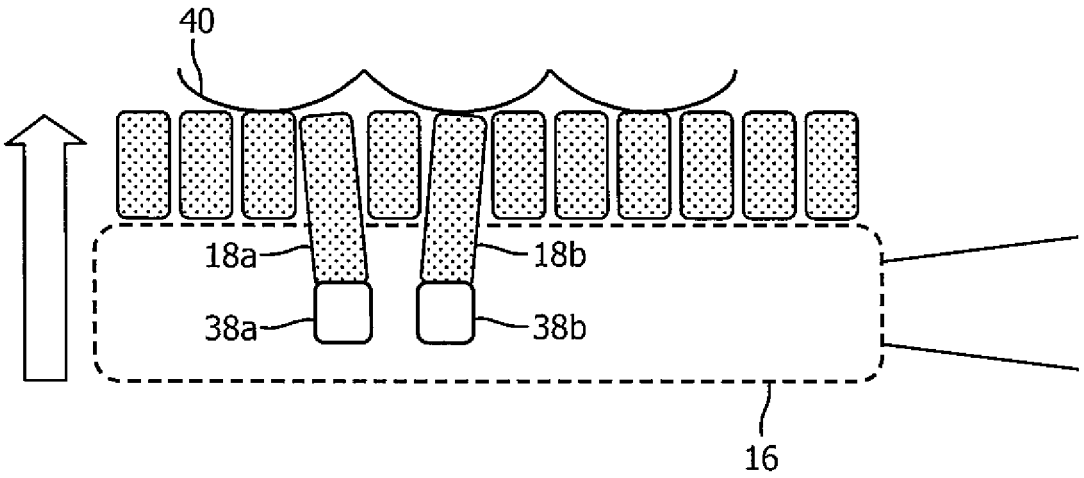
FIG. 5 is a schematic representation of a device head of a personal care device, in accordance with an embodiment.

Referring to FIG. 5, in one embodiment, is a device head 16 of a personal care device 10 interacting with a surface such as one or more teeth 40, as shown here. As the user pushes the device head against the surface in the direction of the arrow, the tufts 18 experience a resistive force. The tufts 18*a* and/or 18*b*, if they subject to the resistive force, will communicate that resistive force to the tactile sensors 38*a* and/or 38*b*. In this example, the sensor data indicates that the tufts 18*a* and 18*b* of the personal care device are currently engaging a dental surface 40.

The sensor data generated by the tactile sensors in response to the resistive force is communicated to the controller, and the personal care device recognizes that a force is being applied. The force may be measured qualitatively, such as an on/off determination of the application of force. Alternatively, the force may be measured quantitatively, including an approximate determination of how much force is being applied. Additionally, the tactile sensors may be configured to detect directional force. For example, instead of responding solely to a direct application of force in a vector largely perpendicular to the surface, tactile sensors 38 may be configured to generate sensor data in response to movement of the tufts in multiple angles, including but not limited to sideways movement of the tufts.

Figure 6:
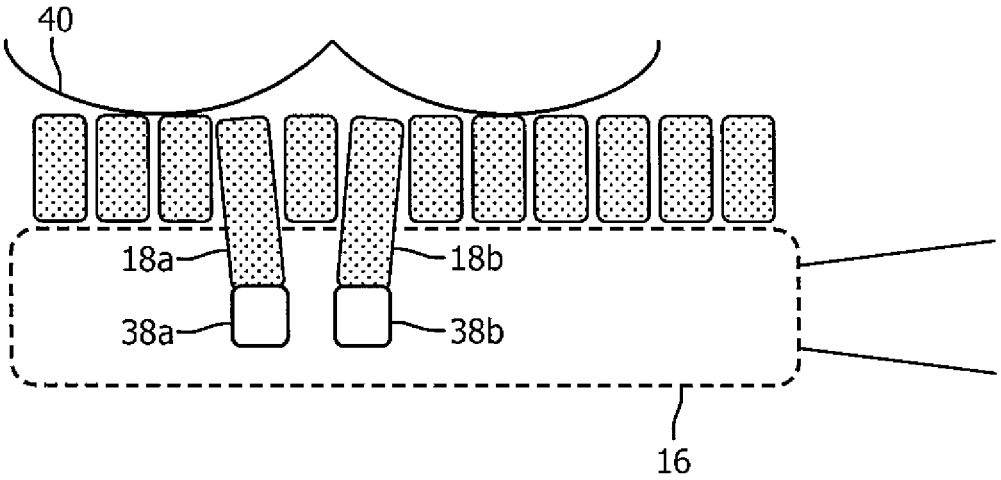
FIG. 6 is a schematic representation of a device head of a personal care device, in accordance with an embodiment.

Referring to FIG. 6, in one embodiment, is a device head 16 of a personal care device 10 interacting with a surface such as one or more teeth 40. As the user pushes the device head against the surface in the direction of the arrow, the tufts 18 experience a resistive force. Compared to FIG. 5, however, the tufts 18*a* and/or 18*b* in this embodiment are located within an interdental space and are not currently experience a resistive force. The tactile sensors are not generating sensor data indicative of an applied force, which indicates that the tufts 38*a* and 38*b* of the personal care device are not currently engaging a surface 40.

Figure 7:
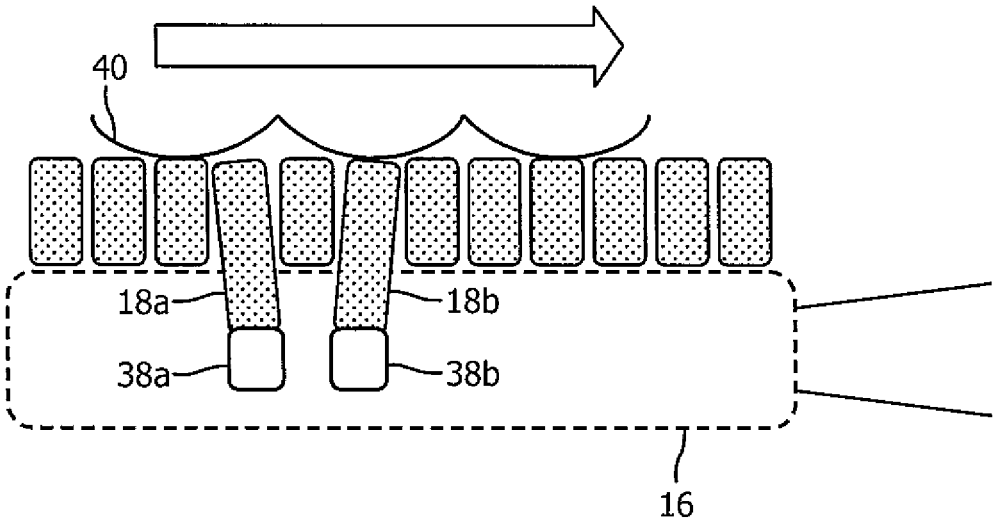
FIG. 7 is a schematic representation of a device head of a personal care device, in accordance with an embodiment.
Figure 8:
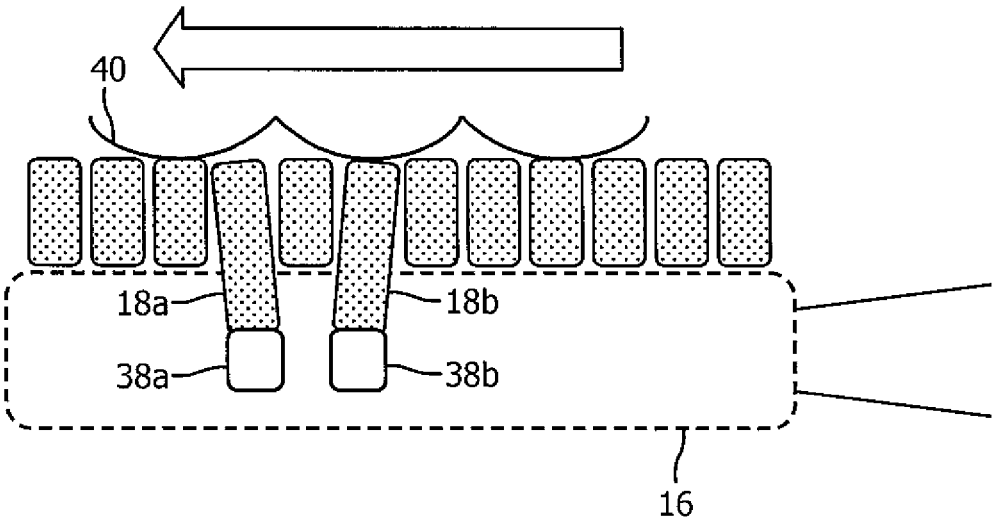
FIG. 8 is a schematic representation of a device head of a personal care device, in accordance with an embodiment.

Referring to FIGS. 7 and 8, is a device head 16 of personal care device 10 in which the user is moving the device head relative to surface 40. In each of these embodiments, the user is moving the device head in the direction of the respective arrows. For example, in FIG. 7, the user is pulling the personal care device and thus the device head backward toward the user. In FIG. 8, the user is pushing or driving the personal care device and thus the device head forward away from the user.

Each of tufts 18*a* and 18*b* will experience a force as a result of movement, and thus each of the tactile sensors 38*a* and 38*b* will generate sensor data. However, since tactile sensors 38*a* and 38*b* comprise different angles, their response to a movement of device head 16 will differ. For example, in FIG. 7, tuft 18*a* is dragging along the surface 40 in the general direction of its natural angle, and thus is not experiencing a significant force, although it is likely experience some force and thus is communicating that force to tactile sensor 38*a* which is generating and communicating sensor data. In contrast, tuft 18*b* is experiencing significant resistive force as it interacts with the surface 40. Accordingly, it is communicating that force to tactile sensor 38*b* which is generating and communicating sensor data. The sensor data generated by tactile sensor 38*b* or 38*a* might be sufficient on its own to indicate a direction of force, although by using sensor data from both of the tactile sensors, the analysis by controller 30 is more robust.

In FIG. 8, tuft 18*b* is dragging along the surface 40 in the general direction of its natural angle, and thus is not experiencing a significant force, although it is likely experience some force and thus is communicating that force to tactile sensor 38*b* which is generating and communicating sensor data. In contrast, tuft 18*a* is experiencing significant resistive force as it interacts with the surface 40. Accordingly, it is communicating that force to tactile sensor 38*a* which is generating and communicating sensor data.

Figure 9:
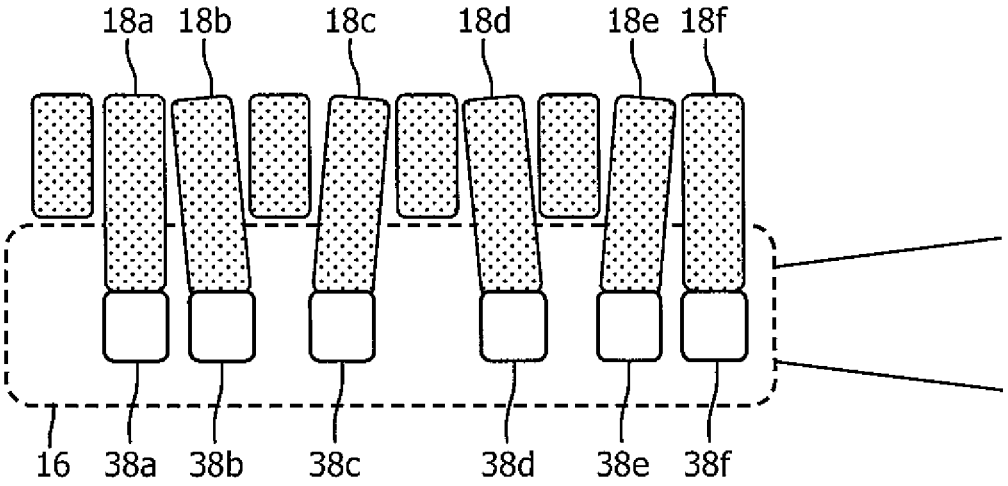
FIG. 9 is a schematic representation of a device head of a personal care device, in accordance with an embodiment.

Referring to FIG. 9, in one embodiment, is device head 16 of personal care device 10 with more than two angled tufts. Instead, there are tufts 18*a* through 18*f* with a multitude of different angles. The device head also comprises a plurality of tactile sensors 18*a* through 18*f*, in this embodiment. The same device head may comprise tufts 18 of two or more different angles. Many other combinations and configurations of tufts and tactile sensors are possible. According to an embodiment, additional tactile sensors 38 may result in greater sensitivity and improved accuracy of localization and movement detection.

According to another embodiment, where sensing is performed entirely within the personal device handle, by measuring the contact force of the overall device head with the surface, the tilted bristle may be present over a large enough area of the brush head to cause a distinguishable signal as the user notches over individual surfaces, such as teeth, as shown here. The notching may be utilized as a means to make the user conscious of cleaning each individual surface, while also aiding navigation.

Figure 10:
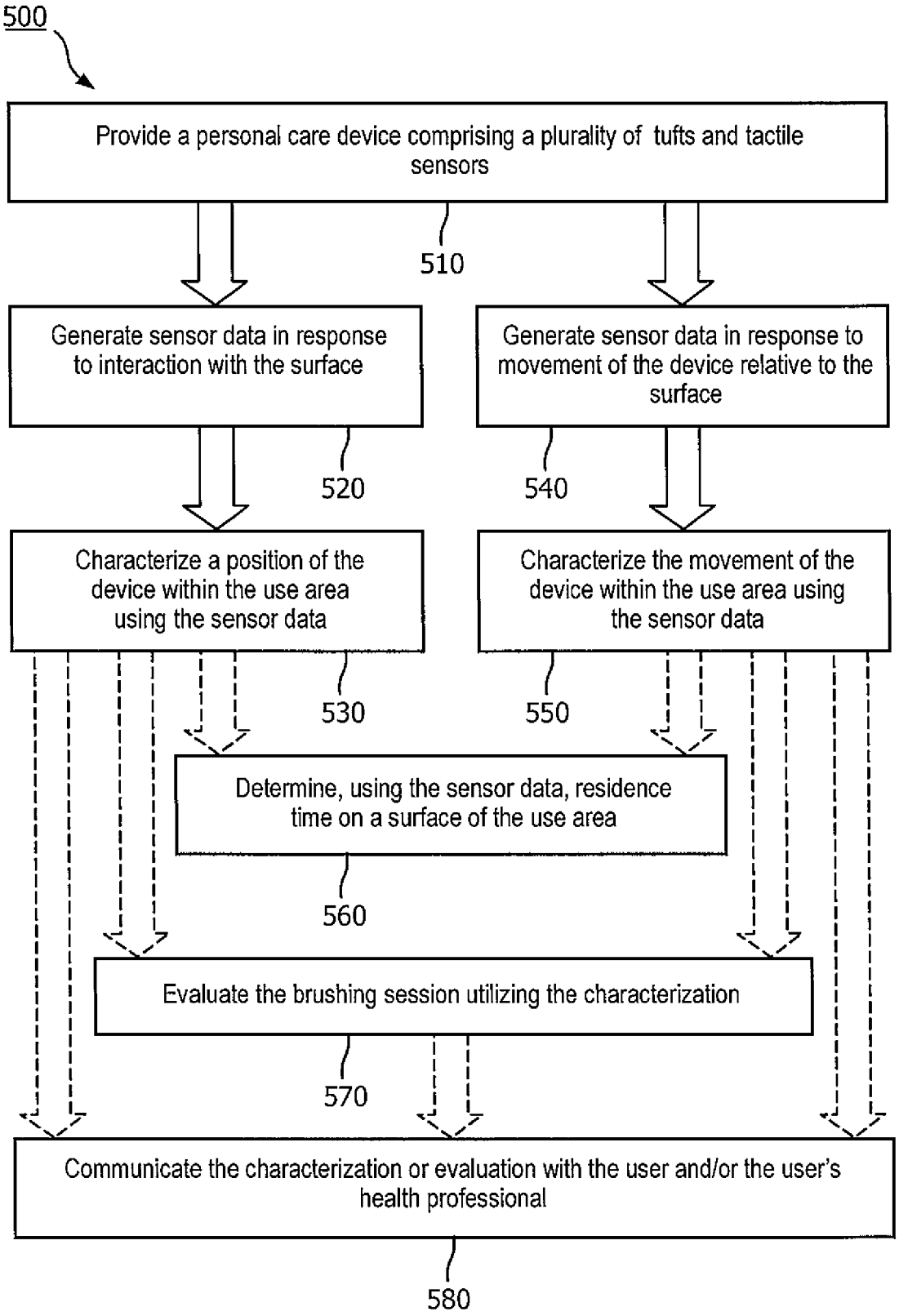
FIG. 10 is a flowchart depicting a method for characterizing a personal care device using sensor input, in accordance with an embodiment.

Referring to FIG. 10, in one embodiment, is a flowchart of a method 500 for characterizing a personal care device using sensor input. At step 510 of the method, a personal care device 10 is provided. The personal care device can be any of the embodiments described or otherwise envisioned herein. For example, according to one embodiment, personal care device 10 includes a body portion 12, a head member 14 with a plurality of tufts 18, two or more tactile sensors 38, and a controller 30 with processor 32 and memory 34. Many other embodiments of the personal care device 10 are also possible.

At step 520 of the method, personal care device 10 is positioned within the area to be cleaned at a first surface 40*a*, and the tufts interact with the surface. This force is communicated to the tactile sensors, and sensor data is generated that measures the force in a qualitative and/or quantitative way. The first tactile sensor 38*a*, in communication with the first tuft 18*a*, generates first sensor data and the second tactile sensor 38*b*, in communication with the second tuft 18*b*, generates second sensor data. Because the first and second tufts comprise different angles, the first and second sensor data will be different. The generated sensor data is communicated to controller 22 where it can be analyzed as described herein. Although this embodiment is described in reference to two tactile sensors, it is recognized that personal care device 10 may comprise many different tactile sensors.

At step 530 of the method, the controller uses the received sensor data to characterize a position of the personal care device within the use area. For example, depending on the position of the device head and/or the direction of motion, the signal of one tuft will be higher than that of another tuft having a different angle. The relative location state of the tufts—such as: (i) centered on a tooth; or (ii) interdental—can be characterized based on the phase of the first and second sensor data. According to an embodiment, the sensor data analysis comprises a comparison of the first sensor data to the second sensor data. According to another embodiment, the analysis comprises a combination of the signals coming from the two or more sensors. For example, one method of analysis comprises thresholding each signal, after which a logic circuit can be used to output a state 1 or state 2 signal. State 1 may indicate a certain action, such as trigging a liquid pulse via a nozzle embedded in the device head, while state 2 may indicate that no liquid should be triggered. Many other configurations are possible.

Additionally, marking points such as first contact of the tufts with the leading edge of a use area where the signals are maximum and the decrease below a certain signal level are indications of (transitions to) these location states. Together with a timing of the signal, the residence time of the tufts on a particular use area surface can be estimated. As described or otherwise envisioned herein, the characterization can be used for a downstream or secondary function, including but not limited to counting state transitions and/or triggering of a liquid pulse for cleaning.

According to an embodiment, a sensor such as an accelerometer can be utilized to further refine the accuracy of the localization. Accordingly, the personal care device 10 may comprise an additional sensor such as an accelerometer. The additional sensor may be any other motion or location sensor. The personal care device 10 can utilize the input from the additional sensor, together with the first and second sensor data, to more accurately determine a position, location, and/or movement of the personal care device 10.

At optional step 560 of the method, the first and/or second sensor data is utilized to determine a residence time of the device head on a surface 40 of the use area, including but not limited to how long is spent at a particular use area or applying a particular force. For example, the controller of the device may comprise a timer that times different signals received from the tactile sensors.

At step 540 of the method, personal care device 10 is positioned within the use area at a first surface 40*a* and is then moved to a second surface 40*b*. This produces a force on the tufts which is communicated to the associated tactile sensors, and sensor data is generated that measures the force in a qualitative and/or quantitative way. The first tactile sensor 38*a*, in communication with the first tuft 18*a*, generates first sensor data and the second tactile sensor 38*b*, in communication with the second tuft 18*b*, generates second sensor data. Because the first and second tufts comprise different angles, the first and second sensor data will be different. The generated sensor data is communicated to controller 22 where it can be analyzed as described herein.

At step 550 of the method, the controller uses the received sensor data to characterize the movement of the personal care device within the use area, using any of the analyses described or otherwise envisioned herein. For example, depending on the position of the device head and/or the direction of motion, the signal of one tuft will be higher than that of another tuft having a different angle. Among the movements that can be characterized by the device are descriptors such as stationary, moving toward the back of the use area, moving toward the front of the use area, and many more.

At optional step 570 of the method, the device can utilize the characterized position and/or movement information obtained during the use session to evaluate that use session. According to an embodiment, the system stores information during a use session in order to create or otherwise perform the evaluation, either immediately or at some point in the future. According to another embodiment, the system stores information about multiple use sessions to accumulate data over time, including improvement in brushing times, technique, or other metric, as well as lack of improvement.

At optional step 580 of the method, the evaluation of the use session can be communicated. For example, the system could communicate information to the user about which regions were adequately cleaned and which regions were not adequately cleaned. This could be performed utilizing a display, such a visual indicator of which regions were adequately brushed, which regions were not adequately brushed, and/or both. According to an embodiment, the system can provide real-time positioning and/or movement information to a user or to a remote system via a wired or wireless network connection. As another example, the system can transmit stored positioning and/or movement data to a computer via a wired or wireless network connection. Thus, the system could transmit information about a single use session and/or multiple use sessions directly to a healthcare professional such as a dentist, dental hygienist, dermatologist or the like.

According to an embodiment, the method could be utilized together with other location sensing or tracking systems in order to improve spatial resolution and information obtained about a use session. According to an embodiment, the method could be utilized to improve the functionality of a liquid cleaning device. For example, a cleaning jet and/or spray embedded in the personal care device may only be activated or applied when the method determines that the device is in the appropriate position. For example, if the spray or jet is intended to target only specific areas, the method can be used to trigger the liquid pulse. Typically the readout of such a sensor is a function of time rather than location. However, with use of the sensor data obtained according to the methods and devices described herein, the functionality of these sensors will be drastically enhanced.

Figure 11:
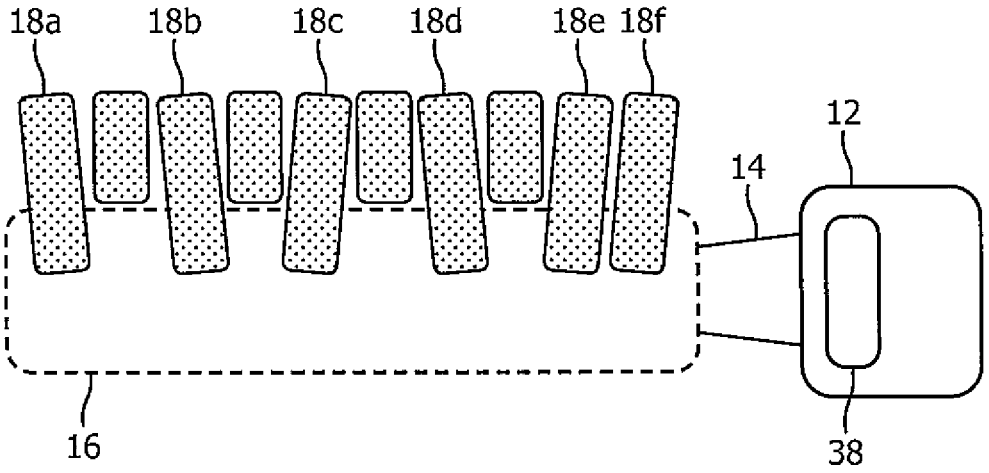
FIG. 11 is a schematic representation of a personal care device, in accordance with an embodiment.

Referring to FIG. 11, in one embodiment, is a personal care device 10 with a device head 16, a body portion 12, and a head member 14. The head comprises tufts 18*a* through 18*f* with a single angle relative to the device head, or as depicted in FIG. 11, tufts with two or more different angles relative to each other. The body portion 12 of the personal care device comprises a tactile sensor 38 that detects a contact force of the device head with the use surface. As a result of the angled tufts interacting with structures within the use area, there is a detectable signal as the user notches over individual surfaces. The notching may be utilized as a means to make the user conscious of cleaning each individual area, while also aiding navigation.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of" or, when used in the claims, "consisting of" will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A personal care device comprising:

a device head comprising a plurality of tufts, wherein a first one of the plurality of tufts is in individual communication with a first tactile sensor and comprises a first angle relative to the device head, and further wherein a second one of the plurality of tufts is in individual communication with a second tactile sensor and comprises a second angle relative to the device head, wherein the first and second angles are different; and a controller configured to: (i) receive, in response to interaction of the plurality of tufts with a use surface, first sensor data from the first tactile sensor and second sensor data from the second tactile sensor; and (ii) characterize, using the first sensor data and the second sensor data, a position of the personal care device within use area.

2. The personal care device of claim 1, wherein the controller is configured to characterize, using the first sensor data and the second sensor data, a movement of the personal care device within the use area.

3. The personal care device of claim 1, wherein the controller is configured to determine, using the first sensor data and/or the second sensor data, a residence time at the use surface by the device head.

4. The personal care device of claim 1, wherein the controller is configured to communicate the characterization.

5. The personal care device of claim 1, wherein the personal care device comprises more than two tactile sensors.

6. The personal care device of claim 1, wherein the first one of the plurality of tufts is in direct communication with a first tactile sensor, and further wherein a second one of the plurality of tufts is in direct communication with a second tactile sensor.

7. A personal care device comprising:

a device head comprising a plurality of tufts, wherein a first one of the plurality of tufts comprises a first angle relative to the device head and a second one of the plurality of tufts comprises a second angle relative to the device head, wherein the first and second angles are different;

a body portion comprising a first tactile sensor in individual communication with the first one of the plurality of tufts and a second tactile sensor in individual communication with the second one of the plurality of tufts, wherein the first and second tactile sensors are configured to detect motion of the device head relative to the body portion, and further wherein the first and second angles are configured to cause a user to feel notching as the plurality of angled tufts interact with a surface; and a controller configured to: (i) receive, in response to interaction of the plurality of tufts with a surface, sensor data from the first and second tactile sensors; and (ii) characterize, using the sensor data, a position of the personal care device within the use area.

8. The personal care device of claim 7, wherein the first one of the plurality of tufts is in direct communication with a first tactile sensor, and further wherein a second one of the plurality of tufts is in direct communication with a second tactile sensor.

9. A method for characterizing a personal care device, the method comprising the steps of:

providing a personal care device comprising a device head having a plurality of tufts, wherein a first one of the plurality of tufts is in individual communication with a first tactile sensor and comprises a first angle relative to the device head, wherein the first angle is greater than or less than 90 degrees relative to the device head, further wherein a second one of the plurality of tufts in in individual communication with a second tactile sensor and comprises a second angle relative to the device head, and further wherein the first and second angles are different;

generating in response to interaction of the plurality of tufts with a surface, first sensor data by the first tactile sensor; and characterizing, by a controller using the first and second sensor data, a position of the personal care device within a use area.

10. The method of claim 9, further comprising the step of determining, using the first sensor data and/or the second sensor data, a residence time at the use surface by the device head.

11. The method of claim 9, further comprising the step of evaluating, based on said characterization, a use session.

12. The method of claim 9, further comprising the step of communicating the characterization.

13. The method of claim 9, wherein the characterizing step comprises a comparison of the first sensor data to the second sensor data.

14. The method of claim 9, wherein the first one of the plurality of tufts is in direct communication with a first tactile sensor, and further wherein a second one of the plurality of tufts is in direct communication with a second tactile sensor.

15. A method for characterizing a personal care device, the method comprising the steps of:

providing a personal care device comprising a body portion, a device head having a plurality of tufts, wherein a first one of the plurality of tufts is in individual communication with a first tactile sensor and comprises a first angle relative to the device head, and further wherein a second one of the plurality of tufts is in individual communication with a second tactile sensor and comprises a second angle relative to the device head, wherein the first and second angles are different;

generating, in response to a movement of the plurality of tufts relative to a use surface, first sensor data by the first tactile sensor and second sensor data by the second tactile sensor; and characterizing, by the controller using the first sensor data and the second sensor data, the movement of the personal care device relative to the use surface.

16. The method of claim 15, further comprising the step of determining, using the first sensor data and/or the second sensor data, a residence time at the use surface by the device head.

17. The method of claim 15, further comprising evaluating, based on said characterization, a use session.

18. The method of claim 15, wherein the first one of the plurality of tufts is in direct communication with a first tactile sensor, and further wherein a second one of the plurality of tufts is in direct communication with a second tactile sensor.

* * * * *